US009605443B2

(12) United States Patent
Shah et al.

(10) Patent No.: US 9,605,443 B2
(45) Date of Patent: Mar. 28, 2017

(54) LIGATURE RESISTANT PUSH-PULL LATCH HANDLE

(71) Applicant: ARCHITECTURAL BUILDERS HARDWARE MFG., INC., Itasca, IL (US)

(72) Inventors: Ankit Kirti Shah, Chicago, IL (US); Daniel Quijano, Itasca, IL (US); Kirti Shah, South Barrington, IL (US)

(73) Assignee: ARCHITECTURAL BUILDERS HARDWARE MFG., INC., Itasca, IL (US)

( * ) Notice: Subject to any disclaimer, the term of this patent is extended or adjusted under 35 U.S.C. 154(b) by 357 days.

(21) Appl. No.: 14/166,390

(22) Filed: Jan. 28, 2014

(65) Prior Publication Data

US 2015/0211253 A1 Jul. 30, 2015

(51) Int. Cl.

| | |
|---|---|
| ***E05B 7/00*** | (2006.01) |
| ***E05B 45/06*** | (2006.01) |
| ***E05C 1/14*** | (2006.01) |
| ***E05B 17/10*** | (2006.01) |

(52) U.S. Cl.

CPC ..... *E05B 7/00* (2013.01); *E05B 45/06* (2013.01); *E05C 1/14* (2013.01); *E05B 17/10* (2013.01); *E05B 2045/0615* (2013.01); *Y10T 292/57* (2015.04)

(58) Field of Classification Search

CPC .. E05B 45/06; E05B 2045/0615; E05B 65/10; E05B 65/108; E05B 7/00; Y10S 292/65; Y10S 292/54; Y10S 292/53; Y10T 292/57; E05C 1/14

USPC ..... 292/92–94, 336.6, 348; 70/208, 210, 70/DIG. 49

See application file for complete search history.

(56) References Cited

U.S. PATENT DOCUMENTS

| | | | | | |
|---|---|---|---|---|---|
| 742,073 | A * | 10/1903 | Schubert | E05B 45/06 | 200/61.64 |
| 2,301,720 | A * | 11/1942 | Tyminski | E05B 45/06 | 200/4 |
| 2,874,240 | A * | 2/1959 | Ricks | E05B 45/06 | 200/61.85 |
| 4,178,587 | A * | 12/1979 | Jamison | G08B 13/06 | 200/61.67 |
| 4,196,422 | A * | 4/1980 | Swigert | E05B 45/06 | 200/61.64 |

(Continued)

FOREIGN PATENT DOCUMENTS

| | | | | |
|---|---|---|---|---|
| DE | 3818187 C1 * | 8/1989 | E05B 85/14 |
| DE | 19930690 A1 * | 1/2001 | E05B 47/00 |
| WO | WO2006074967 A1 * | 7/2006 | E05B 45/00 |

*Primary Examiner* — Andrew Roersma

(74) *Attorney, Agent, or Firm* — Greer, Burns & Crain, Ltd.

(57) ABSTRACT

A push-pull door handle assembly is provided for use with a door having a latch mechanism. The assembly includes a base plate, an actuator linkage associated with the base plate and configured for actuating the latch, a door handle having a working end pivotally connected to the base plate and a free end opposite of the working end configured for manipulation by an operator such that a pushing action on the working end actuates the latch. The door handle is connected to the base plate such that a pulling action on the handle activates an alarm upon the free end reaching a predetermined position.

13 Claims, 8 Drawing Sheets

(56) References Cited

U.S. PATENT DOCUMENTS

| | | | | |
|---|---|---|---|---|
| 4,629,228 | A * | 12/1986 | Marko | E05B 7/00 292/165 |
| 4,785,286 | A * | 11/1988 | Martin | E05B 65/1053 292/92 |
| 5,072,977 | A * | 12/1991 | Millman | E05B 63/04 292/172 |
| 5,730,478 | A | 3/1998 | D'Hooge | |
| 6,196,599 | B1 * | 3/2001 | D'Hooge | E05B 7/00 292/165 |
| 6,283,514 | B1 * | 9/2001 | Letzel | E05B 47/0046 200/43.01 |
| 6,293,598 | B1 | 9/2001 | Rusiana | |
| 6,412,834 | B1 * | 7/2002 | Waitai | E05C 3/10 292/194 |
| 6,784,784 | B1 * | 8/2004 | Zehrung | E05B 17/22 116/17 |
| 7,258,374 | B2 | 8/2007 | Rusiana | |
| 7,481,607 | B2 | 1/2009 | Rusiana et al. | |
| 2010/0101149 | A1 * | 4/2010 | Keller | E06B 5/10 49/399 |
| 2010/0126239 | A1 * | 5/2010 | Berger | E05B 13/005 70/92 |
| 2011/0016971 | A1 * | 1/2011 | Yulkowski | E05F 15/20 73/493 |
| 2011/0068927 | A1 * | 3/2011 | Berger | E05B 47/0046 340/573.1 |

* cited by examiner

LIGATURE RESISTANT PUSH-PULL LATCH HANDLE

BACKGROUND

The present invention relates generally to push/pull type door latch assemblies having paddle style handles of the type used in hospitals, nursing homes, clinics, schools, and other facilities. More specifically, the present latch assembly is designed for applications where it is desired to reduce the chances of cords, wires and/or ropes or the like (hereinafter referred to as "ligatures") being caught on the latch assembly or handle.

Door latches keep a door from opening until an operator disengages the door latch bolt by maneuvering one of the handles. Rotating knob, lever, and push/pull paddle type door handles are known in the art. Because no rotational movement is required to operate push/pull door handles, they are commonly used in health care and educational facilities such as hospitals, nursing homes and schools. One desirable feature of push/pull door handle and latch assemblies is that easy, hands-free opening of a door is possible. Push/pull door handle assemblies conventionally operate so that the door opens with a pushing action on a handle on one side of the door, and with a pulling action on a handle on the other side of the door.

Examples of existing push/pull door latch assemblies are described in U.S. Pat. Nos. 6,293,598; 7,258,374; 7,481,607; 6,196,599 and U.S. Pat. No. 5,730,478, all commonly assigned to Architectural Builders Hardware Manufacturing, Inc., and hereby incorporated by reference. Such door latch assemblies include, generally, a latching mechanism, at least one handle assembly and at least one cam assembly.

In conventional applications, a pull handle of a door latch assembly is mounted on the side of the door toward which the door opens into a room interior, and a push handle of the door latch assembly is mounted on the opposite side of the door. Other configurations are contemplated depending on the application. These assemblies typically incorporate a cam which transfers motion from the pushing or pulling movement of the handle to rotate a drive shaft extending through an opening in a latch cylinder. When rotated, the drive shaft withdraws the door latch, against the force of a return spring, to release the door. Generally, only a small amount of force in one direction is sufficient to release the latch.

In some health care facilities, there is a need for a push-pull latch assembly similar to those described above that is resistant to ligatures becoming caught on portions of the assembly.

SUMMARY

The above-listed need is met by the present push-pull door handle assembly associated with a push-pull latch assembly featuring a push handle in which the handle is constructed and arranged to relatively easily pivot upwardly upon being subject to a pulling action. In practice, such pulling action is in some cases caused by ligatures becoming caught on the handle. Upon a pulling action being exerted on the push handle, the present handle is configured for readily pivoting upward, so that a free end of the handle is located at or above the remainder of the assembly, including a base plate and/or a cover. Another feature of the present assembly is that upon the handle reaching a designated, predetermined upward position, an alarm circuit is activated, generating at least one of a visual and audible alarm signals. In addition, a cover associated with the handle assembly includes a pivoting flap that covers the handle linkage when operational, yet accommodates the upward pivoting action of the handle by also pivoting upward in response to handle movement.

More specifically, a push-pull door handle assembly is provided for use with a door having a latch mechanism. The assembly includes a base plate, an actuator linkage associated with the base plate and configured for actuating the latch, a door handle having a working end pivotally connected to the base plate and a free end opposite of the working end configured for manipulation by an operator such that a pushing action on the working end actuates the latch. The door handle is connected to the base plate such that a pulling action on the handle activates an alarm upon the free end reaching a predetermined position.

In another embodiment, a push-pull door handle assembly is provided for use with a door having a latch mechanism, and includes a first handle assembly configured for mounting to a first side of the door and operating upon a pulling action of a handle relative to a first linkage mechanism, a second handle assembly configured for mounting to a second side of the door and operating upon a pushing action of a second handle relative to a second linkage mechanism, the second handle assembly constructed and arranged such that upon a pulling action upon the handle, the handle being constructed and arranged to pivot upwardly, so that a free end of the second handle is disposed above the second linkage mechanism.

In yet another embodiment, a push-pull door handle assembly is provided for use with a door having a latch mechanism, and includes a base plate, an actuator linkage associated with the base plate and configured for actuating the latch, a door handle having a working end pivotally connected to the base plate and a free end opposite of the working end configured for manipulation by an operator such that a pushing action on the working end actuates the latch. The door handle is connected to the base plate such that a pulling action on the handle causes the handle to pivot into an upward position so that a free end reaches a predetermined position. A cover is constructed and arranged for mounting to the base plate, having a slot for accommodating the handle and including a flap pivotably mounted to the cover and configured for pivoting relative to the cover upon the handle moving to the predetermined position. An alarm circuit is connected to the handle and at least partially mounted to the base plate, and is constructed and arranged for being activated upon the handle reaching the predetermined position.

DETAILED DESCRIPTION

Figure 1:
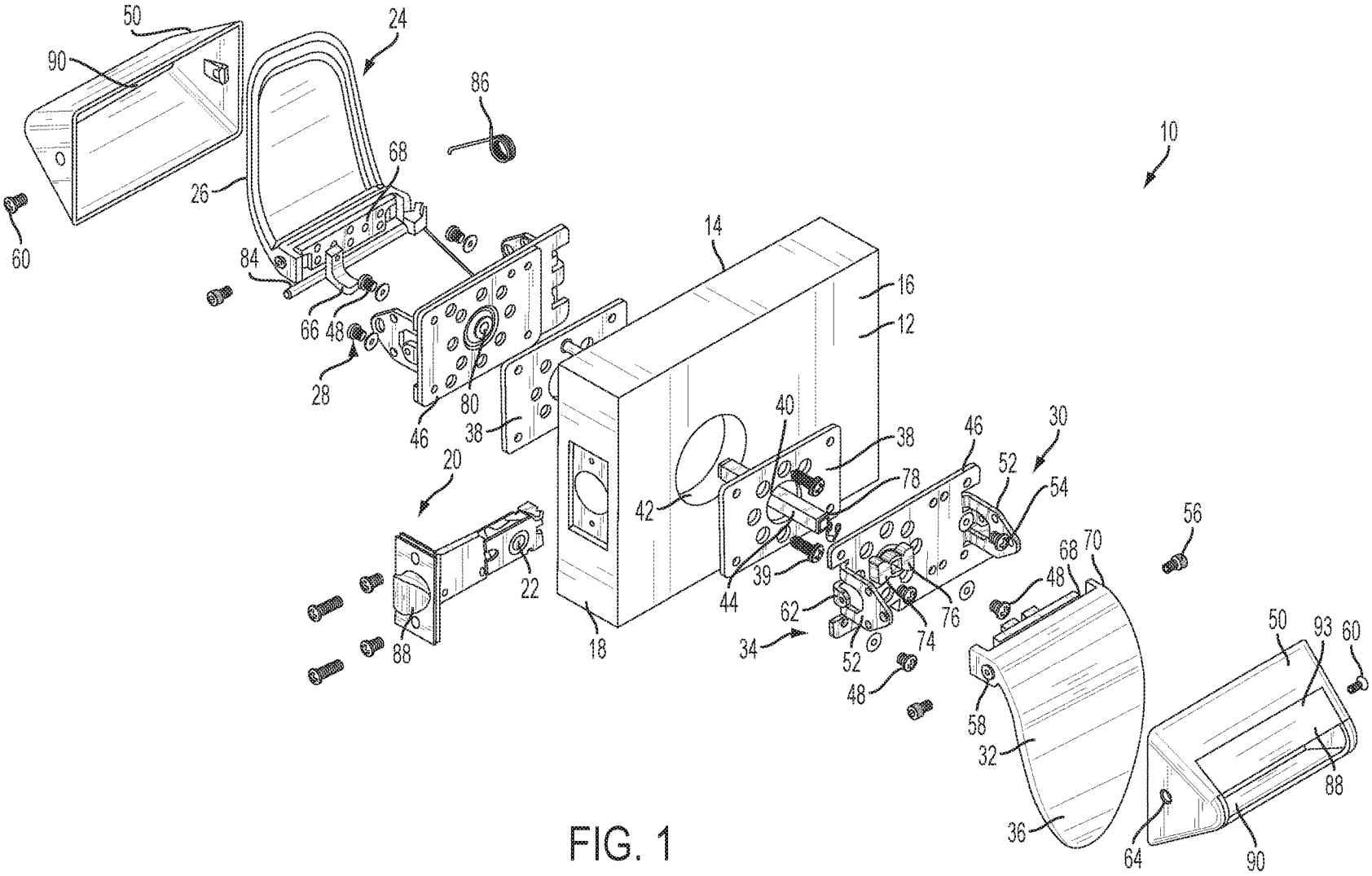
FIG. 1 is an exploded perspective view of the present door handle assembly.
Figure 2:
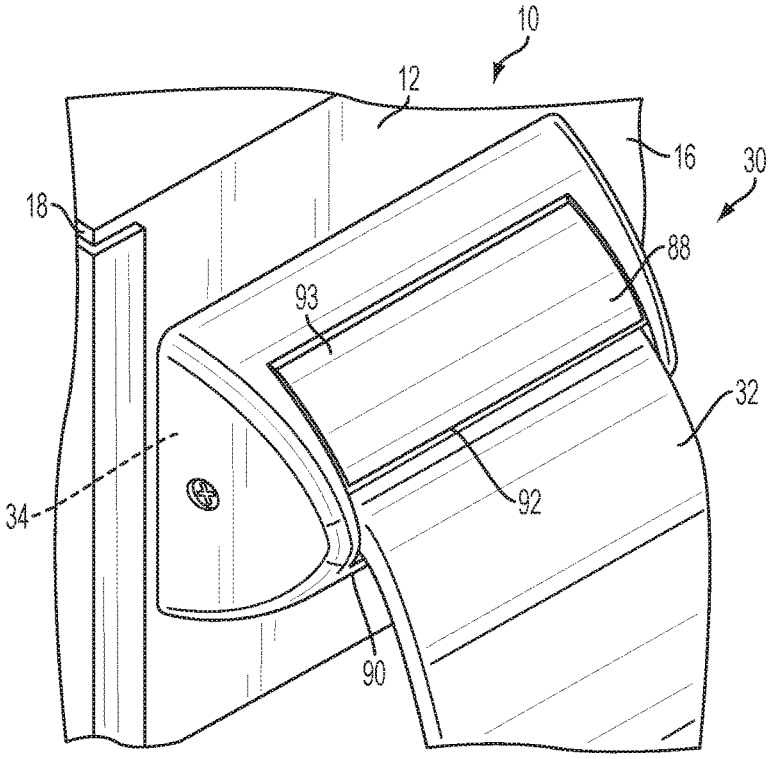
FIG. 2 is a fragmentary top perspective view of a push handle assembly of the present door handle assembly showing the handle in a rest position.
Figure 3:
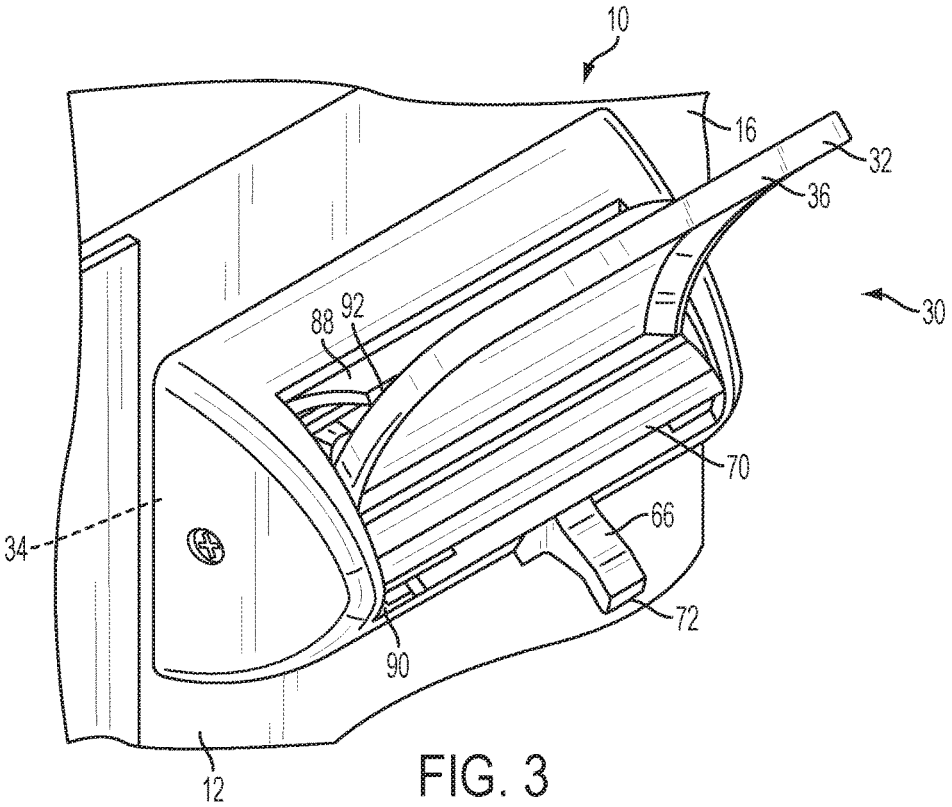
FIG. 3 is a fragmentary top perspective view of the handle of FIG. 2 showing the handle in an upwardly pivoted position.
Figure 5:
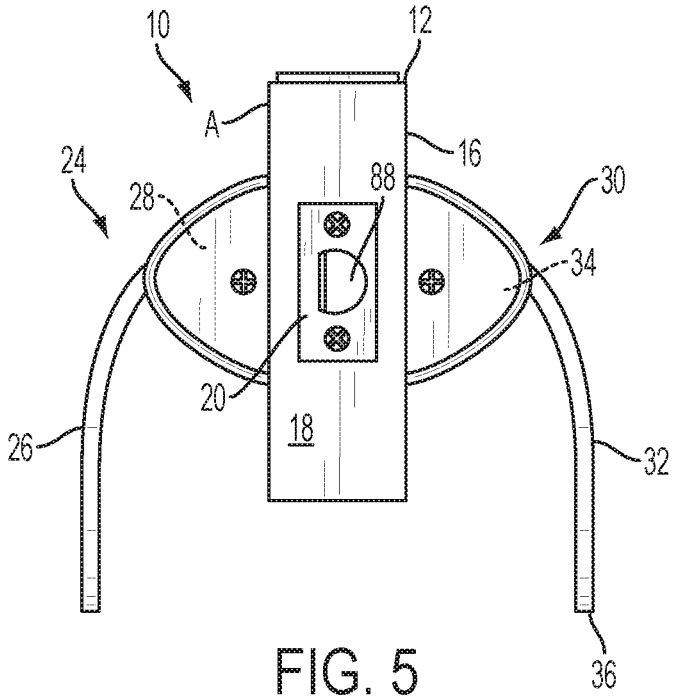
FIG. 5 is a side elevation of the present door handle assembly in the rest position.
Figure 6:
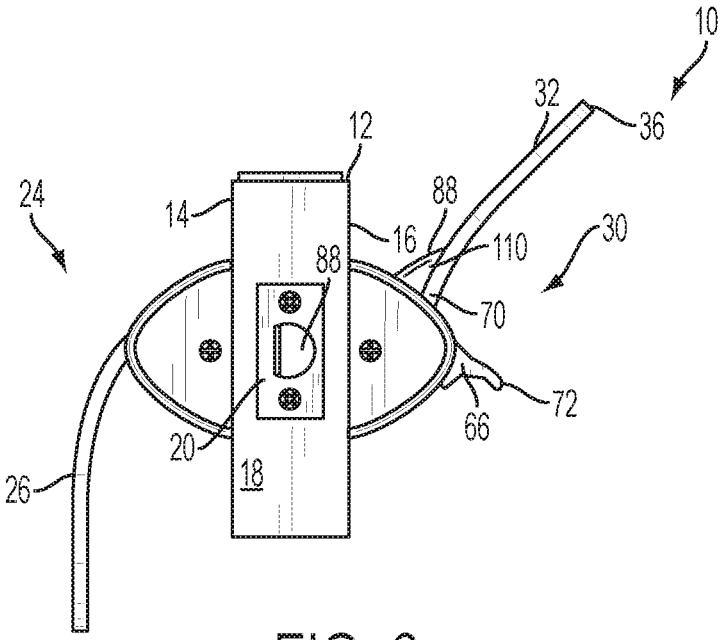
FIG. 6 is a side elevation of the present door handle assembly with the push handle in the upwardly pivoted position.
Figure 7:
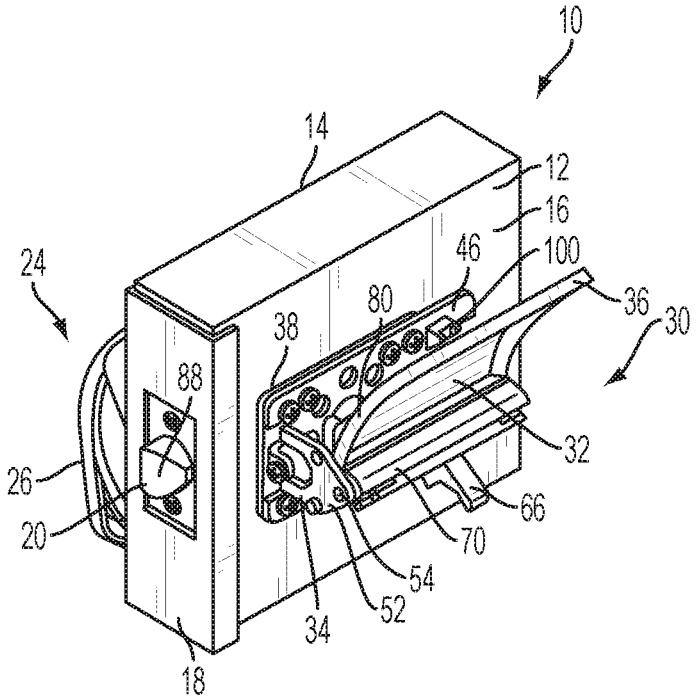
FIG. 7 is a fragmentary top perspective view of the present push handle assembly shown in the upwardly pivoted position with the cover removed.
Figure 8:
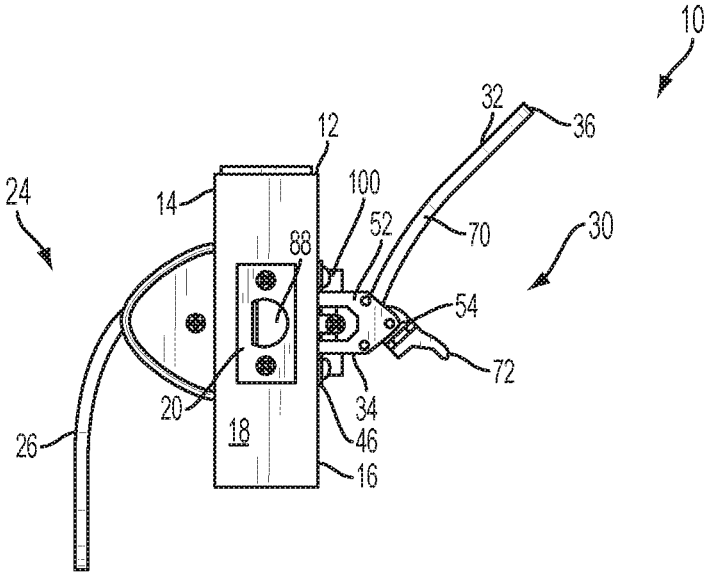
FIG. 8 is a side elevation of the handle assembly shown in FIG. 7.

Referring now to FIGS. 1, 5 and 6, the present door handle assembly is generally designated 10 and is configured for use with a door 12 having a first side, 14, a second side 16, and an edge 18. As is known in the art, the door 12 is equipped with a latch mechanism 20, operated via a transverse, keyed throughbore 22. The present door handle assembly 10 is generally described in commonly-assigned, co-pending U.S. Ser. No. 13/347,433, which is incorporated by reference. However, the present assembly 10 incorporates modifications of the configuration depicted in that application.

Referring now to FIGS. 1-4, the present handle assembly 10 includes a first handle assembly 24 configured for mounting to the first side 14 of the door 12 and operating upon a pulling action of a handle 26 relative to a first linkage mechanism 28, and a second handle assembly 30 configured for mounting on the second side 16 of the door and operating by a pushing action on a second handle 32 through a second linkage mechanism 34. In other words, in the handle assembly 10, there is a pull side assembly 24 and a push side assembly 30. As far as major components, the structure of the first and second handle assemblies 24, 30 are virtually the same, and only the second will be discussed in detail here.

It is contemplated that in a push-pull door latch assembly of this type, the present ligature resistant feature is applied to the push side, which is the second linkage mechanism 34. A main feature of the present door handle assembly 10 is that the second handle assembly 30 is constructed and arranged such that upon a pulling, rather than a customary pushing action upon the second handle 32, the handle is constructed and arranged to pivot upwardly at least to a predetermined position. In one embodiment, a free end 36 of the second handle 32 is disposed on the door 12 above the second linkage mechanism 34. In other words, the pivoting radius is contemplated as at least between approximately 90° and 120° measured from a vertically downward projecting location serving as the 0° point (FIG. 5). It is contemplated that the pivoting radius may be larger than this range, depending on the application. The predetermined position is considered to be some point in the pivoting radius. In the raised position, it becomes more difficult for ligatures to become caught upon the present handle assembly 10.

To mount each handle assembly 24, 30, to the door 12, a lock plate 38 is secured, preferably by fasteners 39, to the door so that an aperture 40 is in registry with a main transverse throughbore 42 in the door. A main latch driveshaft 44 having a noncircular or keyed cross-section as is known in the art, passes through the aperture 40 and, through axial rotation actuates the latch mechanism 20 through engagement in the throughbore 22 as is known in the art.

A base plate 46 is mounted to the lock plate 38 by fasteners 48 and provides the attachment point for both the pivoting handle 32 and a cover 50. Both of these components are mounted to a pair of spaced, generally perpendicularly extending tabs or ears 52. The tabs 52 include threaded pivot apertures 54 for accommodating fasteners 56 engaging bores 58 in the handle 32. The cover 50 is attached to the base plate 46 by fasteners 60 engaging threaded cover bores 62 after passing through mounting apertures 64 in the cover as is known in the art.

Actuation of the latch mechanism 20 is achieved through an actuator linkage, involving engagement of a cam lever or finger 66 fastened to an adapter plate 68 (FIG. 4) which in turn is secured to a working end 70 of the handle 32. The details of the construction of these components are provided in greater detail in co-pending U.S. patent application Ser. No. 13/347,433 which is incorporated by reference. The cam lever 66 has a free end 72 that engages a lobe 74 on a cam 76. In the preferred embodiment, the cam 76 has only the one offset lobe 74 to create clearance for other components of the assembly 10. Also as known in the art, the cam 76 is disposed on one side of the base plate 46 and is non-rotatably engaged upon an end 78 of the drive shaft 44 that passes through a main hole 80 in the base plate 46. Pushing action on the handle 32 causes the lever 66 to cause movement of the cam lobe 74, thus rotating the non-circular drive shaft 44 for activating the latch mechanism 20.

Referring now to FIGS. 3, 4 and 6-8, an important feature of the present door handle assembly 10 is that the second door handle 32 is connected to the base plate 46 such that a pulling action on the handle, instead of the customary pushing action, causes the handle to pivot into an upward position. Ultimately, the handle 32 is pivoted so that the free end 36 of the handle, opposite the working end 70, reaches a predetermined position. In one embodiment the predetermined position is located at or above the base plate 46 as it is seen mounted on the door 12. This upward pivoting movement is achieved by omitting a stop or throughpin 84, and a return spring 86 on the second or push side of the assembly 10, while retaining these components on the first or pull side 24.

It is also contemplated that the pivoting radius is between approximately 90° and 120° measured from a vertically downward projecting location of the handle 32 serving as the 0° point. As the handle 32 is elevated past the 0° point in a pulling rather than a pushing motion, once a specified upward pivoting motion is achieved, an alarm is triggered, described in greater detail below. The amount of upward pivoting motion is contemplated to vary with the application, as long as sufficient upward movement is achieved that would prevent a ligature from becoming caught on the handle 32. In view of the absence of the handle return spring 86, return action of the handle 32 is provided by the spring (not shown) in the latch mechanism 20, which biases a latch member 88 to an extended position as seen in FIG. 1, and as is customary in the art. Thus, the handle 32 is considered to pivot freely, or without resisting spring tension, to the predetermined position.

Figure 4:
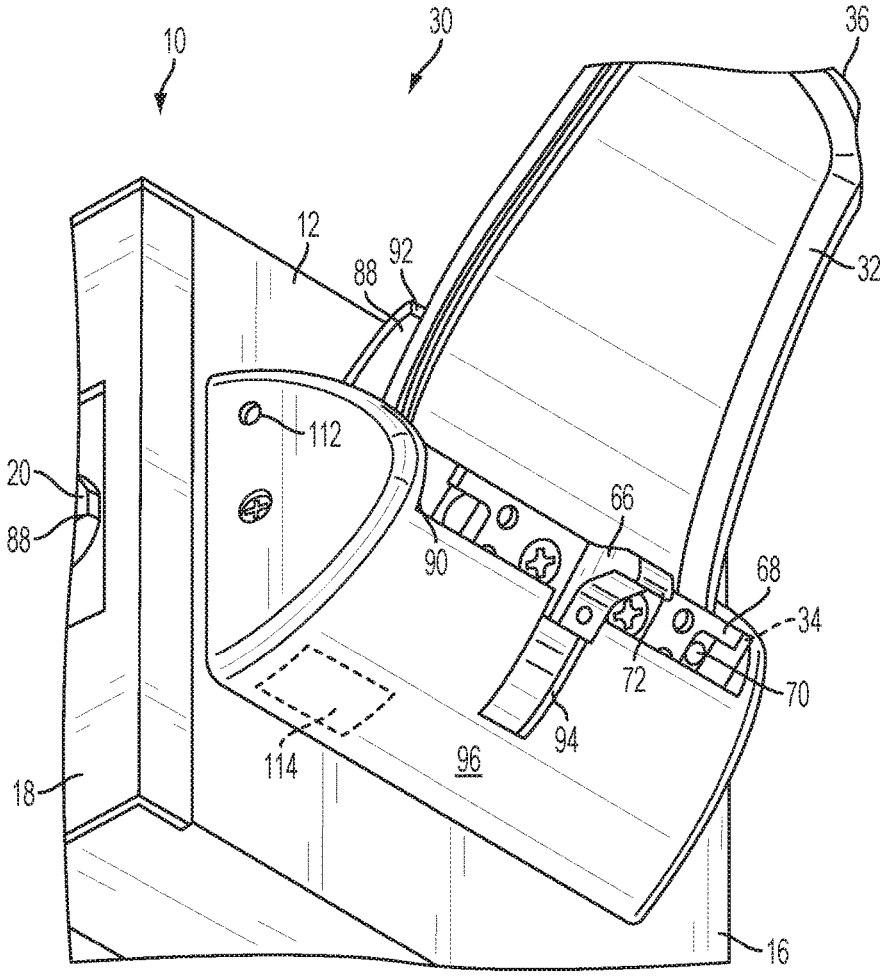
FIG. 4 is a fragmentary bottom perspective view of the handle of FIG. 3.

Referring now to FIGS. 1-4 and 6, to accommodate the upward pivoting movement of the handle 32, in the push assembly 30, the cover 50 is preferably provided with a flap 88 pivotably mounted to the cover, and constructed and arranged to move upwardly relative to the cover as the handle pivots upward. In the preferred embodiment, the flap 88 is dimensioned and is disposed on the cover 50 for accommodating the full extent of the upward pivoting action of the handle 32. In addition, as is the case with conventional covers, the cover 50 has a slot 90 for accommodating the handle 32. The flap 88 partially defines the slot 90 at a free edge 92. A pivot edge 93 of the flap 88 is located approximately mid-way between the slot 90 and a point where the cover 50 engages the door 12. Also, as the handle 32 pivots upward, the cam lever 66 moves outwardly relative to the cover. As such, the cover 50 is also provided with a lever gate 94 on an underside 96 of the cover (FIG. 4). In the preferred embodiment, only the cover 50 on the second or push side 30 is provided with the flap 88 and the lever gate 94.

Referring now to FIGS. 6-9, another feature of the present door handle assembly is that once the handle 32 is pivoted upward, an alarm is triggered, including audible and/or visual components generating appropriate signals for alerting appropriate individuals, such as hospital caregivers, that the handle assembly 10 is being misused. More specifically, an alarm circuit, generally designated 100, includes a power source 102, such as a 9 volt battery; however other sizes or types of batteries are contemplated, as is a line voltage power supply. A switch 104, preferably a reed switch, a pin switch, a snap action switch or the like as known in the art, is preferably located on the base plate 46, on the cover 50 or in some other suitable location in operational proximity to the handle 32 when in the upwardly pivoted position shown in FIGS. 6-8.

In a preferred embodiment, the power source 102, the switch 104 and associated resistor 106 are mounted on the base plate 46. A switch contact 110 (FIG. 6) such as a metallic or magnetic disc, is mounted on the flap 88, preferably on an underside or other concealed location. The location of the contact 110 is such that when the handle 32 moves to the upwardly pivoted position as seen in FIG. 6, a predetermined distance from the rest position (FIG. 5), the contact moves with the flap 88 out of contact with the switch 104 activates the switch. Upon such activation of the switch 104, at least one of a red LED 112 and an audible buzzer 114 (FIG. 4) are energized, these components being located within the cover 50 or on the base plate 46. The red LED 112 is disposed on the push handle assembly 30 on the cover 50 or elsewhere to be readily visible to caregivers or other authorized personnel.

The LED 112 is optionally located remotely from the door handle assembly 10, such as at a nurse's station or remote control panel. It is contemplated that the circuit 100 may be provided as a hard wired version, or in the form of circuit boards, and incorporating integrated circuitry as is known in the art. Also, the buzzer 114 is preferably an 80 decibel alarm, but other power levels are contemplated. The audible alarm from the buzzer 114 continues, and the LED 112 remains illuminated until the handle 32 is replaced to the rest position (FIG. 5).

Figure 9:
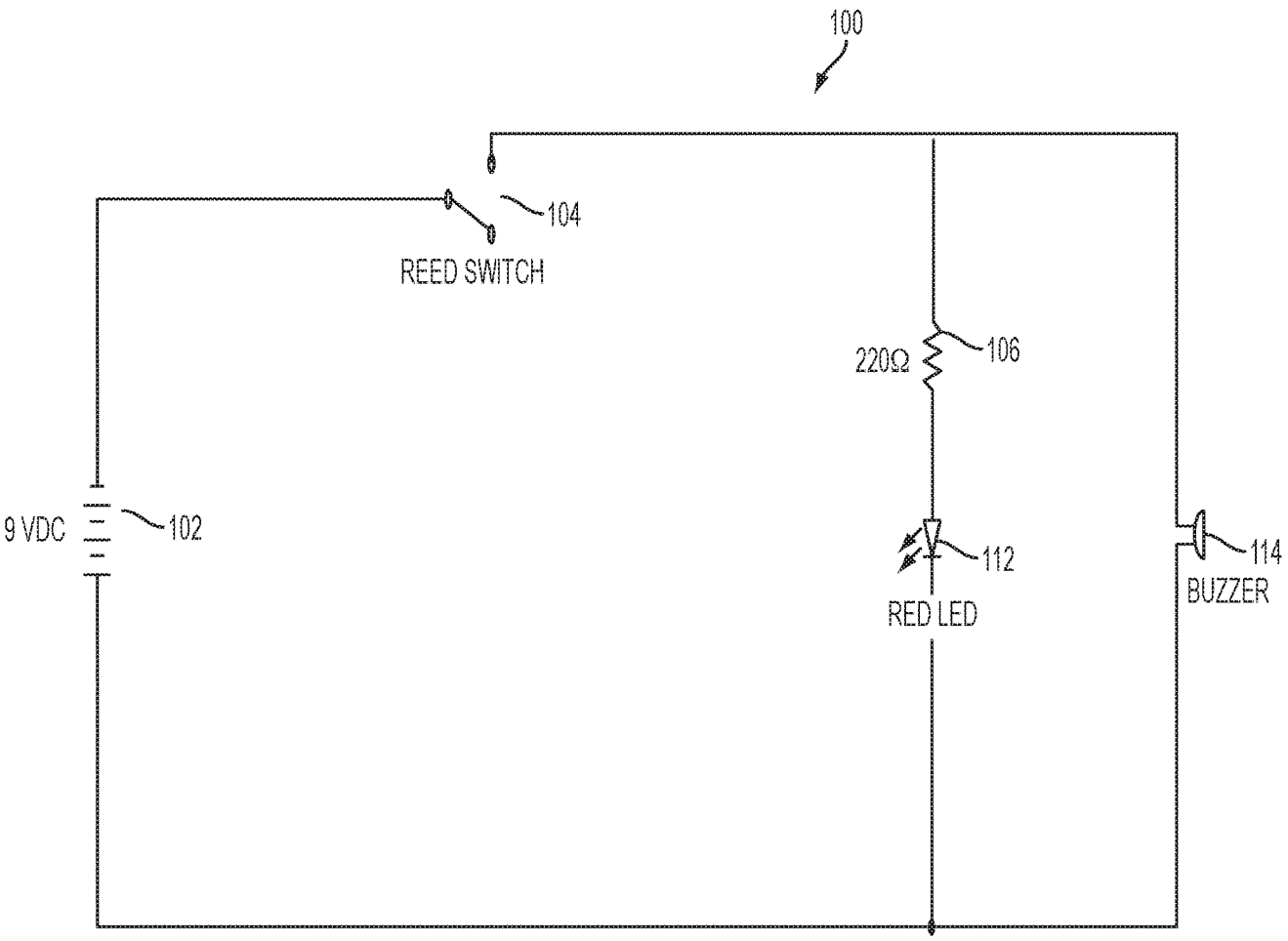
FIG. 9 is an electrical schematic of a first embodiment of the alarm circuit used in the present handle assembly.
Figure 10:
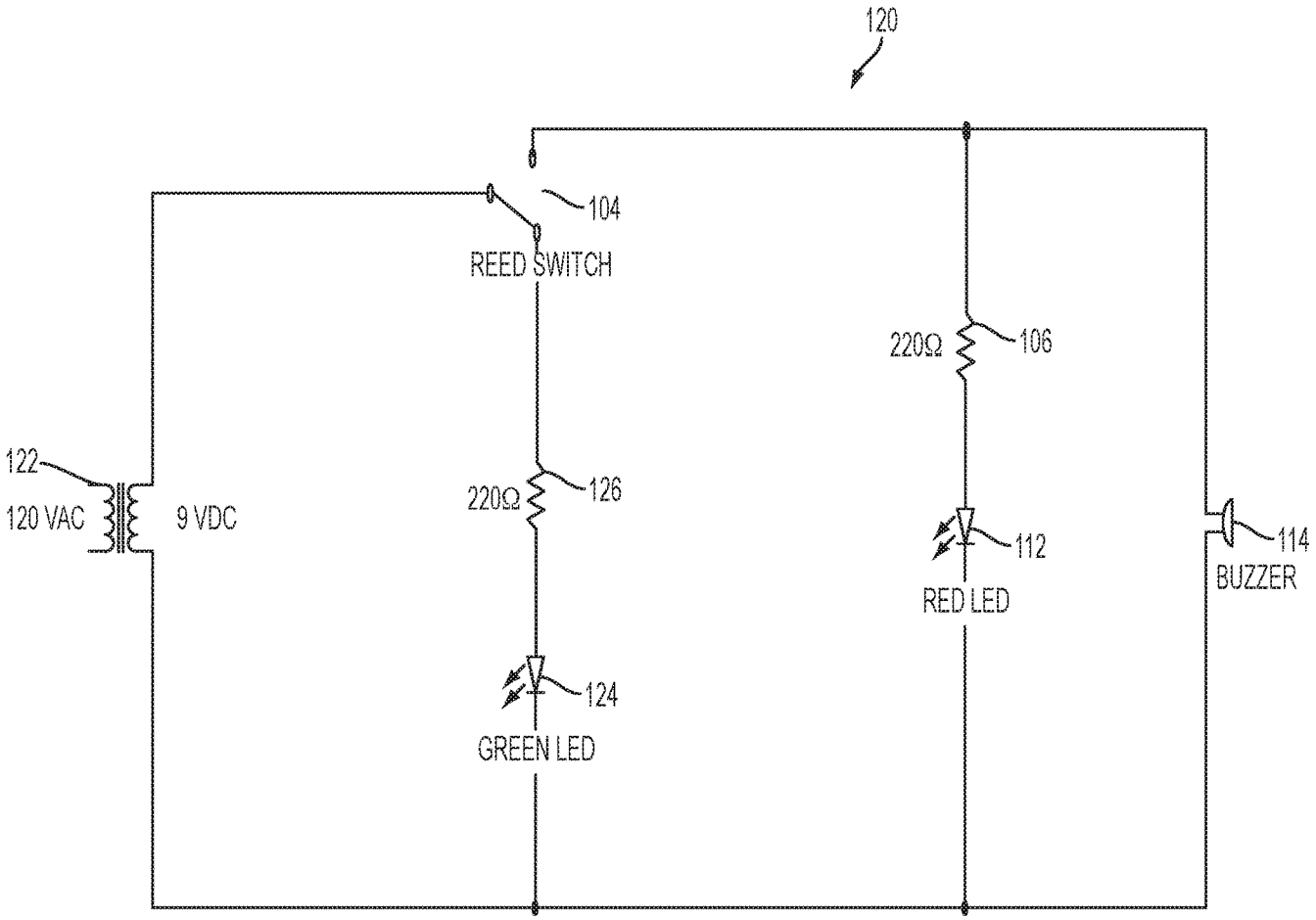
FIG. 10 is an electrical schematic of a first alternative of the present alarm circuit.

Referring now to FIG. 10, an alternate embodiment of the circuit depicted in FIG. 9 is generally designated 120. Identical components shared with the circuit 100 are designated with identical reference numbers. The main difference between circuit 120 and circuit 100 is that the former is hardwired for receiving power from line current. Additional features of the circuit 120 include a transformer 122 and a green LED 124 and a resistor 126 in series. LED's 112, 124 are preferably mounted on the push side 30 of the door assembly 10. The green LED 124 is illuminated when the handle 32 is in the rest position, or is operated properly. As is the case with the circuit 100, in the circuit 120, the LED 112 and the audible alarm 114 are triggered by sufficient upward pivoting motion of the handle 32 such that the contact 110 is out of range of the reed switch 104.

Figure 11:
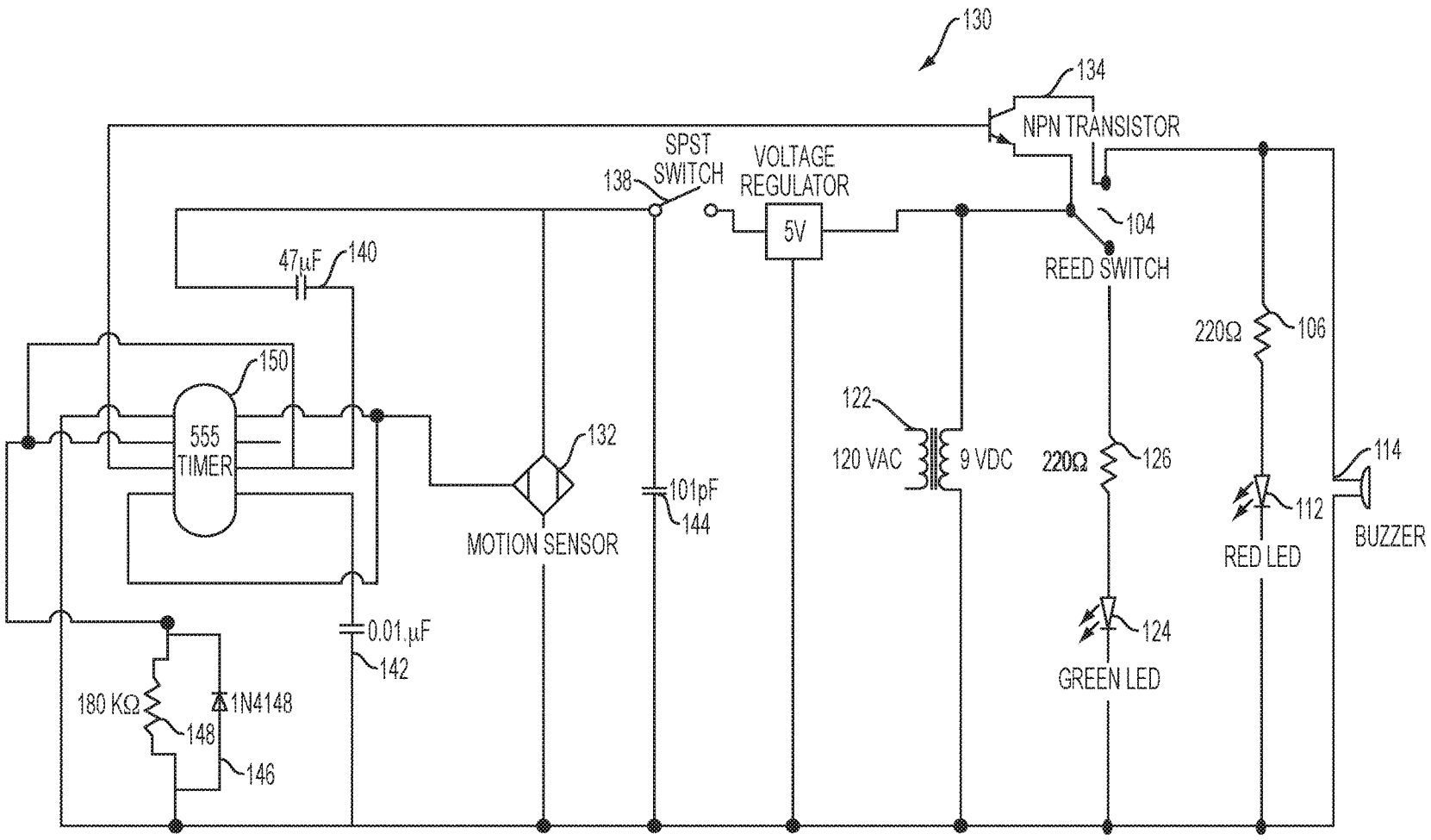
FIG. 11 is an electrical schematic of a second alternative of the present alarm circuit.

Referring now to FIG. 11, another alternate embodiment of the circuit 100 is generally designated 130. Components shared with the circuits 100 and 120 are indicated by identical reference numbers. A main distinguishing feature of the circuit 130 is the inclusion of a motion sensor 132 on at least one of the pull side 24 and the push side 30 of the door handle assembly 10. In the preferred embodiment, the motion sensor 132 is associated with the pull side 24. Also included in the circuit 130 are an NPN transistor 134, a voltage regulator 136, a single pole, single throw toggle-type switch 138, capacitors 140, 142 and 144, a diode 146, a 180 K ohm resistor 148, and a 555 timer 150. Similar to the other circuits, in the circuit 130, if the handle 32 is raised a designated distance, the red LED 112 and the audible alarm 114 are triggered. In addition, the circuit 130 includes the feature that if an individual is in close proximity to the pull handle 26 for more than a predetermined amount of time, sensed by the motion sensor 132 and regulated by the transistor 134, the red LED 112 and the audible alarm are also triggered, even if the handle 32 is not upwardly pivoted. This latter activation also illuminates the green LED 124, so that the resulting LED display changes to an interim color, such as orange.

More specifically, the motion sensor 132 triggers a timing sequence on the timer 150, and after the designated time has elapsed, the timer sends an appropriate signal to the transistor 134, thus completing the circuit for the LED 112 and the alarm buzzer 114. The visual and audible alarms continue until the individual backs away sufficiently from the motion sensor 132, causing the circuit 130 to reset. The SPST switch 138 is used for manually disabling the motion sensor function.

Thus, it will be seen that the present door handle assembly 10, including the second push handle assembly 30, provides an improved system for preventing mishandling or misuse of the handle assembly by generating a warning alarm once the handle 32 reaches an upwardly pivoting position.

While particular embodiments of the present ligature resistant push-pull door handle assembly have been described herein, it will be appreciated by those skilled in the art that changes and modifications may be made without departing from the invention in its broader aspects and as set forth in the following claims.

The invention claimed is:

1. A push-pull door handle assembly for use with a door having a latch mechanism, said assembly comprising:

a base plate;

an actuator linkage associated with said base plate and configured for actuating the latch;

a door handle having a working end pivotally connected to said base plate and a free end opposite of said working end configured for manipulation by an operator such that a pushing action on the working end actuates the latch;

said door handle being connected to said base plate such that a pulling action on said handle activates an alarm upon said free end being moved from a rest position below said base plate to a predetermined position at or above said base plate; said assembly further comprising:

a cover constructed and arranged for mounting to said base plate, having a slot for accommodating said door handle and including a flap mounted to said cover and configured for pivoting relative to said cover upon said door handle moving to said predetermined position;

wherein said flap has a free edge partially defining said slot;

said free edge contacting said door handle as said door handle moves to said predetermined position.

2. The door handle assembly of claim 1 where said free end pivots upward approximately 90° to 120° measured from a vertically downwardly projecting start position.

3. The door handle assembly of claim 1 further including an alarm circuit connected to said handle and at least partially mounted to said base plate, said alarm circuit constructed and arranged for being activated for generating at least one of a visual alarm and audible alarm upon said handle reaching said predetermined position.

4. The door handle assembly of claim 3 wherein said alarm circuit includes a switch activated by upward movement of said handle.

5. The door handle assembly of claim 3 wherein said circuit includes a motion sensor such that the presence of an individual within range of the motion sensor activates said alarm.

6. The door handle assembly of claim 3, wherein said alarm circuit includes at least one colored LED as the visual alarm.

7. The door handle assembly of claim 1 wherein said second handle is freely pivotable to said predetermined position.

8. The door handle assembly of claim 1 wherein said actuator linkage includes a rotating cam actuated by a finger located on said handle, said cam including a single offset lobe.

9. A push-pull door handle assembly for use with a door having a latch mechanism, comprising:

a first handle assembly configured for mounting to a first side of the door and operating upon a pulling action of a first handle relative to a first linkage mechanism;

a second handle assembly configured for mounting to a second side of the door and operating upon a pushing action of a second handle relative to a second linkage mechanism; and an alarm circuit connected to said second handle and at least partially mounted to said base plate, said alarm circuit constructed and arranged for including at least one alarm being activated upon said second handle moving to a predetermined position from a rest position, said second handle assembly constructed and arranged such that upon a pulling action upon said second handle, said handle being constructed and arranged to pivot upwardly, so that a free end of said second handle moves from a rest position below said second linkage mechanism to a predetermined position above said second linkage mechanism; said assembly further comprising: a base plate for mounting said second handle assembly to said second side of said door; a cover constructed and arranged for mounting to said base plate, having a slot for accommodating said second handle and including a flap mounted to said cover and configured for pivoting relative to said cover upon said second handle moving to said predetermined position; wherein said flap has a free edge partially defining said slot; said free edge contacting said second handle as said second handle moves to said predetermined position.

10. The door handle of claim 9, further including an adapter plate securable to said second handle and being constructed for accommodating at least one cam lever.

11. The door handle assembly of claim 9 further including a motion sensor connected to said alarm circuit for determining when an individual is in close proximity to at least one of said first and second handle assemblies, and for triggering said at least one alarm accordingly.

12. A push-pull door handle assembly for use with a door having a latch mechanism, said assembly comprising:

a base plate;

an actuator linkage associated with said base plate and configured for actuating the latch;

a door handle having a working end pivotally connected to said base plate and a free end opposite of said working end configured for manipulation by an operator such that a pushing action on the working end actuates the latch;

said door handle being connected to said base plate such that a pulling action on said handle causes said handle to pivot to an upward position so that said free end moves to a predetermined position at or above said base plate from a rest position below said base plate;

a cover constructed and arranged for mounting to said base plate, having a slot for accommodating said handle and including a flap pivotably mounted to said cover and configured for pivoting relative to said cover upon said handle moving to said predetermined position;

an alarm circuit connected to said handle and at least partially mounted to said base plate, said alarm circuit constructed and arranged for being activated upon said handle reaching said predetermined position; and wherein said flap has a free edge partially defining said slot; said free edge contacting said door handle as said door handle moves to said predetermined position.

13. The door handle assembly of claim 12 wherein said alarm circuit is partially disposed on said flap, such that as said handle pivots to said predetermined position, a switch is activated through proximity to said flap, triggering at least one of a visual and audible alarm signal.

* * * * *